US007261152B2

(12) United States Patent
Smith

(10) Patent No.: US 7,261,152 B2
(45) Date of Patent: Aug. 28, 2007

(54) CABLE DRAWN SNUBBING APPARATUS

(76) Inventor: Lorne G. K. Smith, 17012 - 109 Street, Edmonton, AB (CA) T5X 2T6

( * ) Notice: Subject to any disclaimer, the term of this patent is extended or adjusted under 35 U.S.C. 154(b) by 279 days.

(21) Appl. No.: 11/125,671

(22) Filed: May 10, 2005

(65) Prior Publication Data

US 2006/0043349 A1 Mar. 2, 2006

(30) Foreign Application Priority Data

May 10, 2004 (CA) ..... 2465927

(51) Int. Cl.
*E21B 19/048* (2006.01)

(52) U.S. Cl. ..... 166/77.1; 166/385; 254/359

(58) Field of Classification Search ..... 166/77.1, 166/385
See application file for complete search history.

(56) References Cited

U.S. PATENT DOCUMENTS 1,894,912 A 1/1933 Otis
2,555,145 A * 5/1951 McKinney ..... 254/29 R
2,927,642 A * 3/1960 Meredith, Jr. et al. ... 166/75.11
3,012,619 A * 12/1961 Farque ..... 173/140
3,757,858 A * 9/1973 Davis et al. ..... 166/77.1
3,797,570 A * 3/1974 Leutwyler ..... 166/77.4
3,999,610 A 12/1976 Sage et al.
4,119,297 A 10/1978 Gunther

* cited by examiner

*Primary Examiner*—Hoang Dang
(74) *Attorney, Agent, or Firm*—Christensen O'Connor Johnson Kindness PLLC

(57) ABSTRACT

A cable drawn snubbing apparatus includes a first track and a second track in parallel spaced relation. A carriage extends between and engages the first track and the second track. Pipe engaging slips are carried by the carriage. Upper cables extend from the carriage to an upper end of the first track and the second track. Lower cables extend from the carriage to a lower end of the first track and the second track. Upper winches exert a force upon the upper cables to pull the carriage toward the upper end. Lower winches exert a force upon the lower cables to pull the carriage toward the lower end.

12 Claims, 5 Drawing Sheets

CABLE DRAWN SNUBBING APPARATUS

FIELD OF THE INVENTION

The present invention relates to snubbing apparatus which is used to insert and remove pipe from an oil well or a gas well and, in particular, such a unit which is drawn by cables.

BACKGROUND OF THE INVENTION

Virtually all pipe snubbing apparatus currently used to insert and remove pipe from oil wells or gas wells are hydraulically actuated. Some recent accidents with hydraulic snubbing apparatus have resulted in renewed interest in cable drawn pipe snubbing apparatus. In one recent accident, the hydraulic pipe snubbing apparatus failed without warning and well pressure propelled a length of pipe from the well with such force that it killed a rig worker who had the misfortune to be standing in the vicinity.

U.S. Pat. No. 1,894,912 (Otis 1933) is an example of a cable drawn pipe snubbing apparatus. However, the configuration of the Sage et al patent is not viewed as being suited to the present needs of the oil and gas industry.

U.S. Pat. No. 3,999,610 (Sage et al 1976) and U.S. Pat. No. 4,119,297 (Gunther 1978) use a combination of cables and hydraulics.

SUMMARY OF THE INVENTION

What is required is a cable drawn snubbing apparatus better suited to the current needs of the oil and gas industry.

According to the present invention there is provided a cable drawn snubbing apparatus which includes a first track and a second track. The first track has an upper end and a lower end. The second track is in parallel spaced relation to the first track and has an upper end and a lower end. A carriage extends between and engages the first track and the second track. Pipe engaging slips are carried by the carriage. Upper cables extend from the carriage to the upper end of the first track and the upper end of the second track. Lower cables extend from the carriage to the lower end of the first track and the lower end of the second track. Upper drive means are provided for exerting a force upon the upper cables to pull the carriage toward the upper end of the first track and the upper end of the second track. Lower drive means are provided for exerting a force upon the lower cables to pull the carriage toward the lower end of the first track and the lower end of the second track.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

Figure 1:
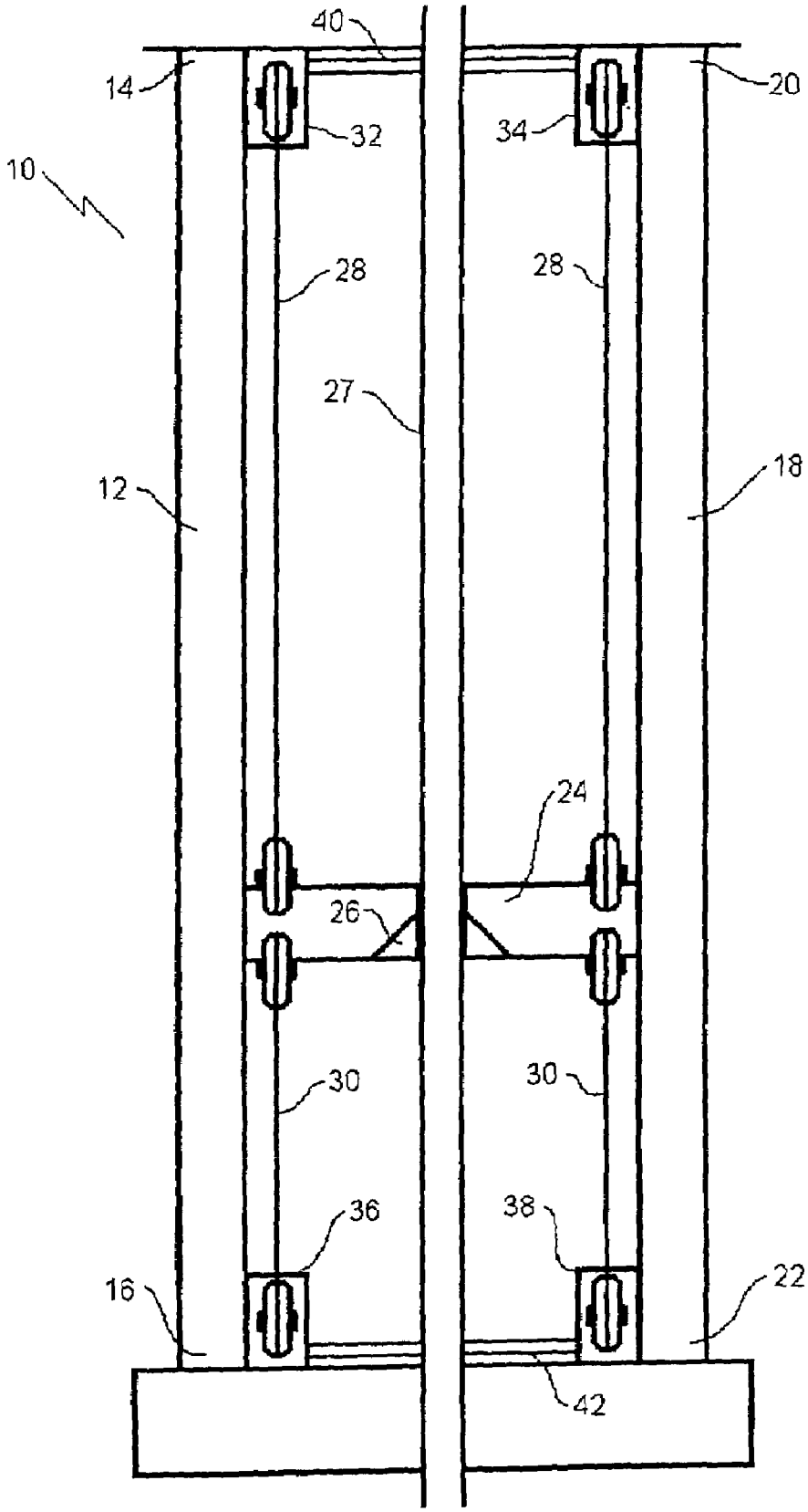
FIG. 1 is a side elevation view of a cable drawn snubbing apparatus constructed in accordance with the teachings of the present invention.

The preferred embodiment, a cable drawn snubbing apparatus generally identified by reference numeral 10, will now be described with reference to FIGS. 1 and 2.

Structure and Relationship of Parts:

Referring now to FIG. 1, there is shown cable drawn snubbing apparatus 10, which includes a first track 12 having an upper end 14 and a lower end 16 and a second track 18 in parallel spaced relation to first track 12, which also has an upper end 20 and a lower end 22. A carriage 24 extends between and engages first track 12 and second track 18. Pipe engaging slips 26 are carried by carriage 24, and engage pipe 27. Upper cables 28 extend from carriage 24 to upper end 14 of first track 12 and upper end 20 of second track 18. Lower cables 30 extend from carriage 24 to lower end 16 of first track 12 and lower end 22 of second track 18. There is upper drive means provided by upper winches 32 and 34 for exerting a force upon upper cables 28 to pull carriage 24 toward upper ends 14 and 20 of first track 12 and second track 18 respectively. There is also lower drive means provided by lower winches 36 and 38 for exerting a force upon lower cables 30 to pull carriage 24 toward lower ends 16 and 22 of first track 12 and second track 18, respectively. Upper winches 32 and 34 and lower winches 36 and 38 are coupled by timing belts 40 and 42, respectively, to operate synchronously.

Figure 2:
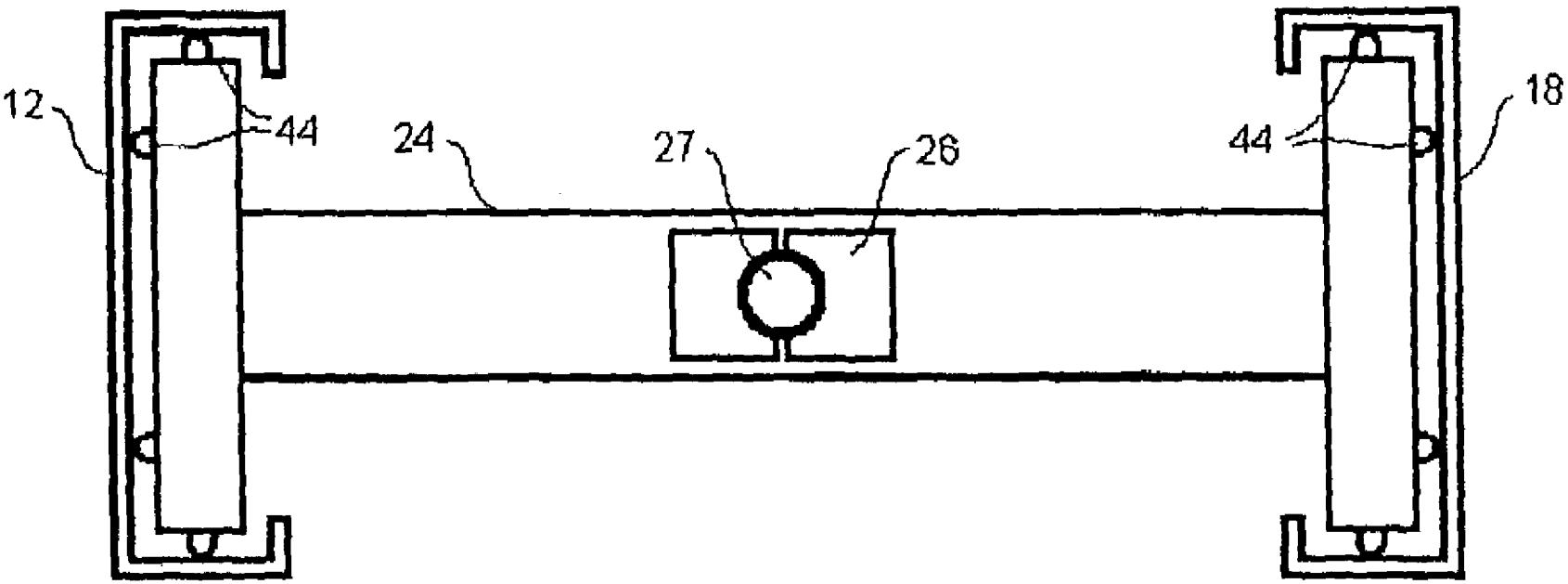
FIG. 2 is a top plan view of the cable drawn snubbing apparatus illustrated in FIG. 1.

Referring to FIG. 2, an example of how carriage 24 engages first track 12 and second track 18, where each side of carriage 24 is received within the respective track, and tracks 12 and 18 extend partially around the sides to provide stabilization. Rollers 44 are shown to reduce friction when carriage 24 is raised or lowered. It will be understood that other engagement strategies are possible. For example, the sides of carriage 24 could receive tracks 12 and 18 instead of the opposite.

Operation:

The operation and use of cable drawn snubbing apparatus 10 will now be discussed with reference to FIGS. 1 and 2. Apparatus 10 is arranged as shown in FIGS. 1 and 2 with pipe 27 engaged by slips 26, and carriage 24 engaging first and second tracks 12 and 18. At the beginning of a stroke, carriage 24 is at the upper ends 14 and 20 of first and second tracks 12 and 18. Lower winches 36 and 38, synchronized by timing belt 42, pull lower cables 30 which in turn pull carriage 24 toward lower ends 16 and 22 of first and second tracks 12 and 18. As carriage 24 is lowered, pipe 27 is forced downward into a drilled well. At the bottom of the stroke, winches 36 and 38 stop pulling lower cables 30, and winches 32 and 34, synchronized by timing belt 40, pull upper cables 28 which in turn raises carriage 24. The stroke can then be repeated.

Alternative Embodiments:

A second embodiment of the winch and cable driven pipe snubbing apparatus generally identified by reference numeral 100, will now be described with reference to FIGS. 3 and 4.

Figure 3:
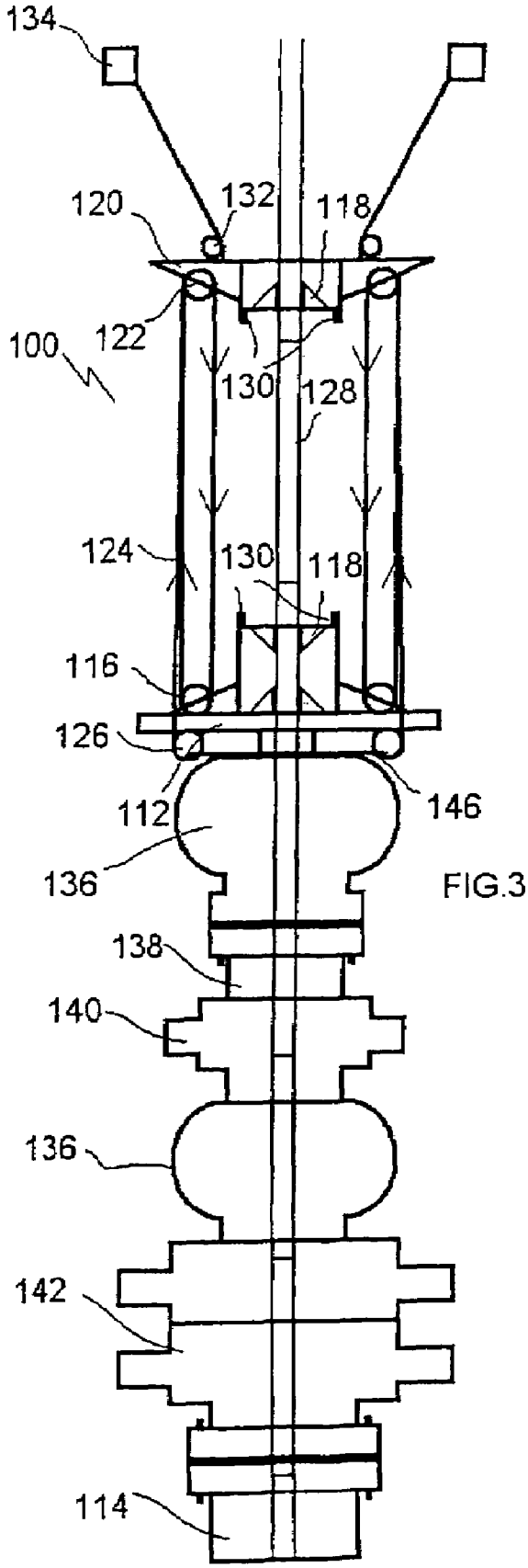
FIG. 3 is a front elevation view of second embodiment of a winch and cable driven pipe snubbing apparatus constructed in accordance with the teachings of the present invention, with the travelling body in a raised position.
Figure 4:
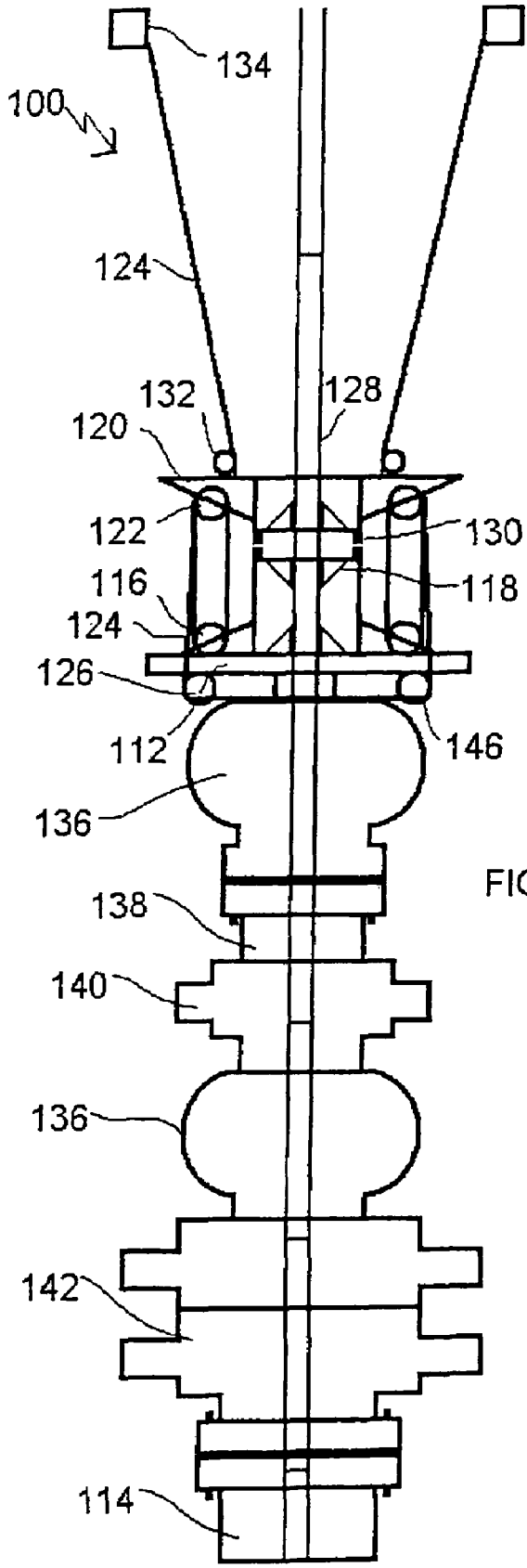
FIG. 4 is a front elevation view of the second embodiment illustrated in FIG. 3, with the travelling body in a lowered position.

Referring now to FIG. 3, there is shown the second embodiment 100 which includes a stationary body 112 adapted to be affixed onto a well head 114. Stationary body 112 has two pairs of spaced apart rotatably mounted pulleys 116 as shown, however, any convenient number is possible. There is also a first set of slips 118 on stationary body 112. A travelling body 120 is disposed above stationary body 112 where travelling body 120 has two pairs of spaced apart rotatably mounted pulleys 122. There is also included a primary pair of winches 126 mounted in spaced apart relation to stationary body 112, and slips 118. A cable 124 extends from each winch of the primary pair of winches 126 around one of the pulleys of the pair of pulleys 116 mounted on stationary body 112 and around one of the pulleys of the pair of pulleys 122 mounted on travelling body 120. A timing chain 128 extends between primary pair of winches 126 to coordinate the operation of primary pair of winches 126 so that they draw in cable 124 in unison to pull travelling body 120 vertically downward toward stationary body 112, thereby forcing pipe 128 into the well head 114. There are impact absorbing stops 130 provided to dampen physical contact when travelling body 120 comes in physical contact with stationary body 112. There is also a secondary pair of winches 132 positioned on travelling body 120 which serve as means for moving travelling body 120 vertically upward and away from stationary body 112 by means of cables 124 extended from each secondary pair of winches 132 to a rig 134.

Referring to FIG. 3, stationary body 112 is connected to well head 114 by multiple parts, which may vary from case to case. As shown, stationary body 112 is directly mounted to a snub annular 136, which is mounted to an equalize spool 138, which is mounted to a snub pipe ram 140, which is mounted to another snub annular 142, which is mounted to a double blow out preventer 144, which is mounted on well head 114.

Operation of Second Embodiment:

The operation of second embodiment of winch and cable driven pipe snubbing apparatus 100 will now be discussed with reference to FIGS. 3 and 4. Referring now to FIG. 3, pipe 128 is gripped by slips 118 on travelling body 120. Primary winches 126 wind in cable 124 around pulleys 122 and 116. This pulls travelling body 120 down toward stationary body 112, forcing pipe 128 into well head 114. A chain 146 may be connected between the winches to synchronize the timing. When travelling body 120 reaches stationary body 112 as shown in FIG. 4, absorbing stops 130 dampen the physical contact to avoid any damage. Slips 118 on stationary body 112 then grip the pipe and slips 118 on travelling body 120 are loosened, so that travelling body 120 may be raised by winches 132, connected by cable 124 to rig 134. The process may then be repeated.

The apparatus 100 as described has many advantages, such as increased safety, being able to snub 30' of pipe per stroke, which makes the process quicker, and a reduced crew size, for example, from the customary eight workers to about five.

A third embodiment of the winch and cable driven pipe snubbing apparatus generally identified by reference numeral 200, will now be described with reference to FIG. 5.

Figure 5:
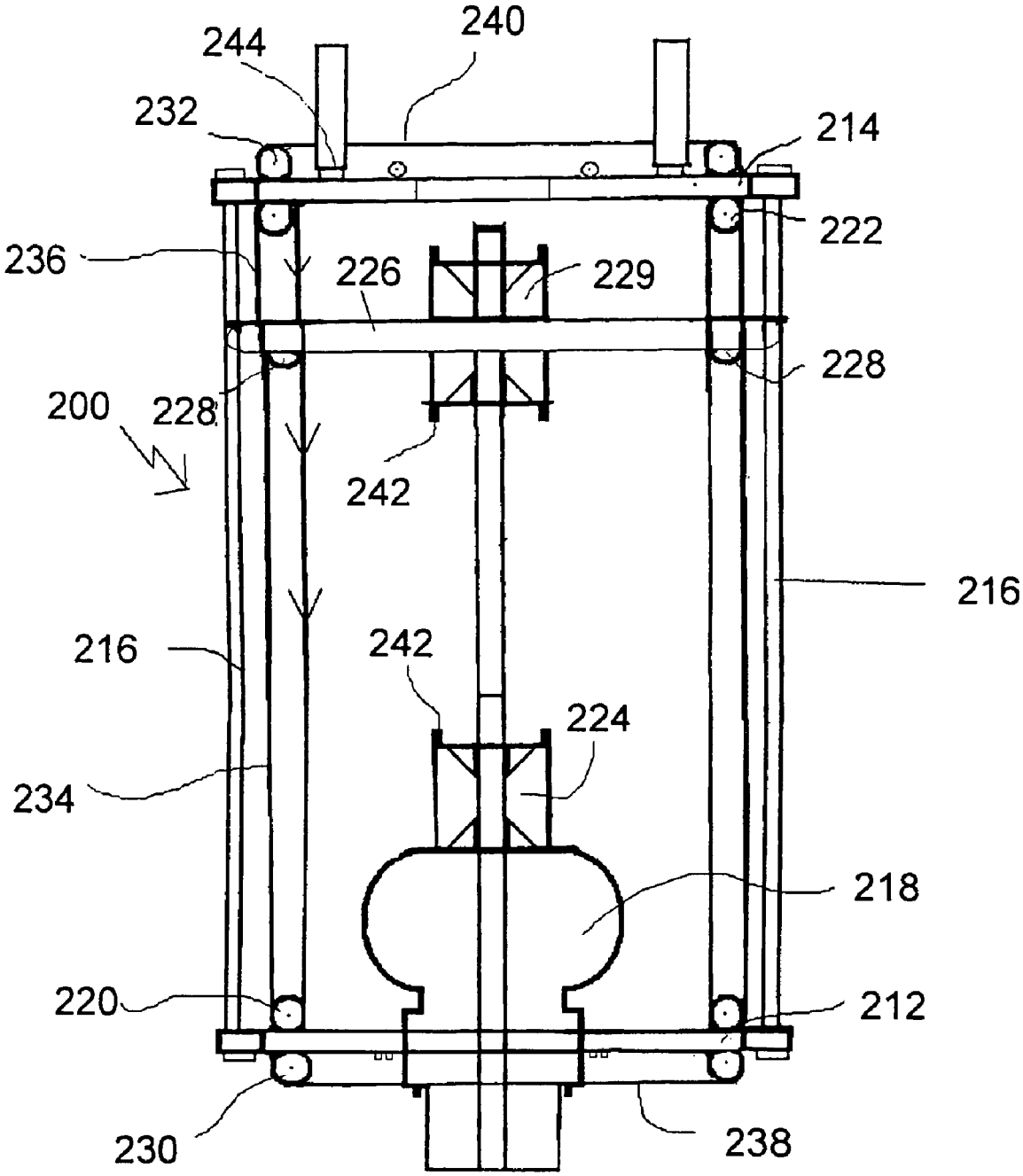
FIG. 5 is a side elevation view of a third embodiment of the cable drawn snubbing apparatus having support cables.

Referring now to FIG. 5, there is shown third embodiment 200 which includes a first stationary body 212 and a second stationary body 214. Cables 216 extend between first stationary body 212 and second stationary body 214. First stationary body 212 is adapted to be affixed onto a well head 218. First stationary body 212 has three pairs of spaced apart rotatably mounted pulleys 220 as shown, however, any convenient number is possible. Second stationary body 214 also has three pairs of spaced apart rotatably mounted pulleys 222 as shown, however, again any convenient number is possible. There is also a first set of slips 224 on first stationary body 212. A travelling body 226 is disposed above first stationary body 212 and below second stationary body 214. Travelling body 226 has six airs of spaced apart rotatably mounted pulleys 228. Travelling body 226 is also provided with a second set of slips 229. A primary pair of winches 230 are mounted in spaced apart relation to first stationary body 212 and a second pair of winches 232 are mounted in spaced apart relation to second stationary body 214. A first cable 234 extends from each winch of the primary pair of winches 230 around on the one of the pulleys of the pair of pulleys 220 mounted on first stationary body 212 and around one of the pulleys of the pair of pulleys 228 mounted on travelling body 226. A second cable 236 extends from each winch of the second pair of winches 232 around on the one of the pulleys of the pair of pulleys 232 mounted on second stationary body 214 and around another of the pulleys of the pair of pulleys 228 mounted on travelling body 226. A first timing chain 238 extends between primary pair of winches 230 and a second timing chain 240 extends between second pair of winches 232 to coordinate the operation of primarily pair of winches and second pair of winches 232. Impact absorbing stops 242 provided on first set of slips 222 and second set of slips 229 to dampen physical contact when travelling body 226 comes in physical contact with stationary body 212. Second stationary body 214 is adapted to be secured to blocks 244 of a rig.

With first embodiment 10 and second embodiment 100, cable snubbing apparatus is a rigid structure. With third embodiment 200, cables 216 provide a collapsible structure for ease of transport. The cable structure is tensioned between the well head 218 and the travelling block 244 of the rig.

Although not illustrated, a braking assembly can be incorporated into the travelling body so that travelling body can be locked into position and prevented from travelling.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

The invention claimed is:

1. A cable drawn snubbing apparatus, comprising:

a first track having an upper end and a lower end;

a second track in parallel spaced relation to the first track, the second track having an upper end and a lower end;

a carriage extending between and engaging the first track and the second track;

pipe engaging slips carried by the carriage;

upper cables extending from the carriage to the upper end of the first track and the upper end of the second track;

lower cables extending from the carriage to the lower end of the first track and the lower end of the second track;

upper drive means for exerting a force upon the upper cables to pull the carriage toward the upper end of the first track and the upper end of the second track; and lower drive means for exerting a force upon the lower cables to pull the carriage toward the lower end of the first track and the lower end of the second track.

2. The cable drawn snubbing apparatus as defined in claim 1, wherein the upper drive means includes two upper winches coupled by a timing belt to operate synchronously.

3. The cable drawn snubbing apparatus as defined in claim 1, wherein the lower drive means includes two lower winches coupled by a timing belt to operate synchronously.

4. The cable drawn snubbing apparatus as defined in claim 1, wherein the first track and the second track are rigid.

5. The cable drawn snubbing apparatus as defined in claim 1, wherein the first track and the second track are flexible cables placed in tension.

6. A winch and cable driven pipe snubbing apparatus, comprising:

a stationary body adapted to be affixed onto a well head, the stationary body having at least one pair of spaced apart rotatably mounted pulleys;

a first set of slips on the stationary body;

a travelling body disposed above the stationary body, the travelling body having at least one pair of spaced apart rotatably mounted pulleys;

means for moving the travelling body vertically upward and away from the stationary body;

at least one winch mounted to one of the stationary body or the travelling body; and cable extending from the at least one winch around one pulley of each of the at least one pairs of pulleys mounted on the stationary body and around one pulley of each of the at least one pairs of pulleys mounted on the travelling body, such that when the at least one winch draws in cable the travelling body is pulled vertically downward toward the stationary body, thereby forcing pipe into the well head.

7. The winch and cable driven pipe snubbing apparatus as defined in claim 6, wherein the stationary body and the travelling body come in physical contact, with impact absorbing stops being provided to dampen such physical contact.

8. The winch and cable driven pipe snubbing apparatus as defined in claim 6, wherein more than one pair of pulleys is provided on each of the stationary body and the travelling body in order to increase the mechanical advantage.

9. The winch and cable driven pipe snubbing apparatus as defined in claim 6, wherein a pair of winches are provided in spaced relation.

10. The winch and cable driven pipe snubbing apparatus as defined in claim 6, wherein a timing chain extends between the pair of winches and serves to coordinate the operation of the pair of winches.

11. The winch and cable driven pipe snubbing apparatus as defined in claim 6, wherein at least one secondary winch is positioned on the travelling body and serves as means for moving the travelling body vertically upward and away from the stationary body when cables are extended from the at least one secondary winch to a rig.

12. A winch and cable driven pipe snubbing apparatus, comprising:

a stationary body adapted to be affixed onto a well head, the stationary body having more than one pair of spaced apart rotatably mounted pulleys;

a first set of slips on the stationary body;

a travelling body disposed above the stationary body, the travelling body having more than one pair of spaced apart rotatably mounted pulleys;

a primary pair of winches mounted in spaced apart relation to the stationary body;

cable extending from each winch of the primary pair of winches around one pulley of each of the more than one pair of pulleys mounted on the stationary body and around one pulley of each of the more than one pair of pulleys mounted on the travelling body;

a timing chain extending between the primary pair of winches to coordinate the operation of the primary pair of winches so that they draw in cable in unison to pull the travelling body vertically downward toward the stationary body, thereby forcing pipe into the well head;

impact absorbing stops being provided to dampen physical contact when the travelling body comes in physical contact with the stationary body; and a secondary pair of winches positioned on the travelling body and serving as means for moving the travelling body vertically upward and away from the stationary body by means of cables extended from the each of the secondary pair of winches to a rig.

* * * * *